United States Patent [19]

Alden et al.

[11] Patent Number: 5,045,862

[45] Date of Patent: Sep. 3, 1991

[54] DUAL POLARIZATION MICROSTRIP ARRAY ANTENNA

[75] Inventors: Adrian W. Alden, Sainte Cecile de Masham; Tom T. Ohno, Carp, both of Canada

[73] Assignee: Her Majesty the Queen in right of Canada, as represented by the Minister of Communications, Ottawa, Canada

[21] Appl. No.: 447,401

[22] Filed: Dec. 7, 1989

[30] Foreign Application Priority Data

Dec. 28, 1988 [CA] Canada ..... 587182

[51] Int. Cl.[5] ..... H01Q 1/38

[52] U.S. Cl. ..... 343/700 MS; 343/848

[58] Field of Search ..... 343/700 MS, 829, 846, 343/848

[56] References Cited

U.S. PATENT DOCUMENTS 4,079,268 3/1978 Fletcher et al. ..... 343/700 MS 4,180,817 12/1979 Sanford ..... 343/700 MS

*Primary Examiner*—Michael C. Wimer

*Attorney, Agent, or Firm*—Pascal & Associates

[57] ABSTRACT

Dual polarization microstrip array antennas for high efficiency power reception or transmission of electromagnetic waves are described. The antennas are easy to manufacture, applicable over a wide range of frequencies and angles of incidence, and permit true conformal application and high power handling. The antenna, according to an embodiment, has an array of microstrip patch antenna elements, wave filters, matching stubs and rectifier terminals, all highly symmetrically arranged to each other on one side of a dielectric layer. A common ground plane is provided on the other side of the dielectric layer. Rectifiers are connected to the terminals to produce rectified outputs of each patch antenna element.

16 Claims, 4 Drawing Sheets

DUAL POLARIZATION MICROSTRIP ARRAY ANTENNA

FIELD OF THE INVENTION

The present invention relates to antennas for transmitting or receiving electromagnetic waves and, more specifically, is directed to microstrip array antennas having a plurality of antenna units symmetrically arranged for improved performances.

BACKGROUND OF THE INVENTION

Microwave antennas are widely used in communications, radioastronomy, radiotelemetry, radars, etc. It has also been widely proposed and experimented to use electromagnetic waves for energy transmission between two separated locations. There is a need for a cost-effective means for the reception and conversion of electromagnetic power to direct current power more suitable for moving platforms on which the reception/conversion system is located. A rectifying antenna is customarily called a rectenna and includes antenna elements and rectifiers directly connected to them to produce a direct current output. An exemplary application of the rectenna in which this need arises is the provisioning of 30 KW or more of propulsive and communications payload power for lightweight electrically-powered aircraft. In operation, such aircraft would circle over fixed ground antenna systems, transmitting power in the 2.4 to 2.5 GHz microwave ISM band, for continuous periods of weeks or months at a time and relay communication signals between separated locations.

Of course, there are many other applications in which the supply of energy to a remotely located station is desired in the form of electromagnetic waves, thus eliminating the needs of physical connections, e.g. wires, pipes, and permitting the station to be movable. It is also advantageous to provide antennas which can perform equally well for microwaves of various polarizations.

Various microstrip array antennas have been proposed for microwave uses. U.S. Pat. No. 4,464,663 to Larezari et al (Aug. 7, 1984) describes a dual polarized microstrip antenna. The antenna comprises a pair of spaced apart resonant microstrip radiators and specifically designed x and y feedlines which achieve respective polarizations while minimizing undesirable rf coupling between x and y input/output ports. While it is an important consideration to achieve good polarization isolation in the fields such as communications, radars, etc., power reception by microwave antennas requires optimum sensitivity to signals regardless of the polarization.

U.S. Pat. No. Re: 29,911 to Munson (Feb. 13, 1979) teaches a high gain phased array antenna which is, in his preferred embodiment, made by the printed circuit board technique. While described as possible to radiate linearly and/or circularly polarized radiation, the feedline designs indicate that the antenna is not equally sensitive to x and y polarizations.

U.S. Pat. No. 4,943,811 July 24, 1990 (Alden et al) describes a dual polarization power reception and conversion system. This device consists of two orthogonal arrays of linearly-polarized thin film rectennas of specific format and element spacings. This antenna has proven to be highly efficient and to have a wide range of angles of reception. However, it has certain drawbacks in its manufacture, mechanical assembly and power handling capability. Each of the two rectenna foreplanes is manufactured by etching of both sides of the conductor-clad dielectric sheet from which it is made, with close registration required between back and front circuit elements. These four etching steps become increasingly problematic and costly as the system frequency increases. In addition, the system thickness required is approximately $\lambda_o/4$ or more, where $\lambda_o$ is the wavelength of the electromagnetic energy in free space. At lower microwave frequencies this can result in a system thickness preventing true conformal application. That is, the rectenna structure has to be integrated mechanically with both the skin and support structure of the moving platform, with only approved dielectric allowed between foreplanes and reflector. The mechanical assembly is also complicated by the requirement of insulation between antenna foreplanes. Thirdly, the power handling capability of this prior art system is limited to one rectification unit for each polarization with power dissipation limited to radiative and convective cooling of the exposed foreplanes only.

U.S. Pat. No. 4,079,268 to Fletcher et al (Mar. 14, 1978) describes an alternative power conversion system. This design eliminates the manufacturing, installation and power handling problems discussed above but is only applicable to a circularly polarized transmission system. Such a system, requiring correct phasing of orthogonal polarizations, may be considerably more complex and costly than the linear or dual transmitter system and is also susceptible to performance degradation due to depolarization.

SUMMARY OF THE INVENTION

As will be discussed in detail below, the aforementioned deficiencies of the prior art rectennas and antennas are significantly reduced with the present invention. Briefly stated, the present invention is a dual polarized microstrip array antenna for power reception or transmission of electromagnetic waves. The antenna has a plurality of symmetrically arranged identical antenna units. Each antenna unit comprises a patch antenna element of side $\mathbf{1}_m$ and a plurality of identical feedlines, each of which is symmetrically attached to the patch antenna element and has identical microstrip filters, a terminal for an antenna feed, and identical microstrip matching stubs for shorting the transmission line waves at the fundamental and second harmonic. The array antenna further comprises a dielectric layer of a predetermined thickness on one side of which the plurality of the identical antenna units are arranged symmetrically in an array by dc connecting appropriate feedlines of adjacent antenna units and a common ground plane provided on the other side of the dielectric layer.

OBJECTS OF THE INVENTION

It is an object of the present invention to provide an improved microstrip array antenna which has a high degree of symmetry for dual polarization.

It is another object of the present invention to provide a microstrip array antenna which is easy to manufacture.

It is a further object of the present invention to provide a microstrip array antenna with better power handling capability characteristics.

It is yet another object of the present invention to provide a microstrip array antenna characterized by a wide range of reception angles to allow relative movement between the reception and the transmission systems.

BRIEF DESCRIPTION OF THE DRAWINGS

Other objects, features and advantages of the present invention will be apparent from the following description taken in connection with the accompanying drawings, wherein.

DETAILED DESCRIPTION OF PREFERRED EMBODIMENTS

It should be noted that while the following description deals mainly with the square patch antenna element in a square array, it should be evident to those skilled in the art to visualize and construct array antennas which have a high degree of symmetry but not in a square format. The description which follows will deal with a good technique for readily conceptualizing the behaviour of a microstrip antenna array with or without additional circuit elements and hence optimizing the efficiency of power reception or transmission. The same argument can be readily adapted in cases of formats other than square.

Figure 1:
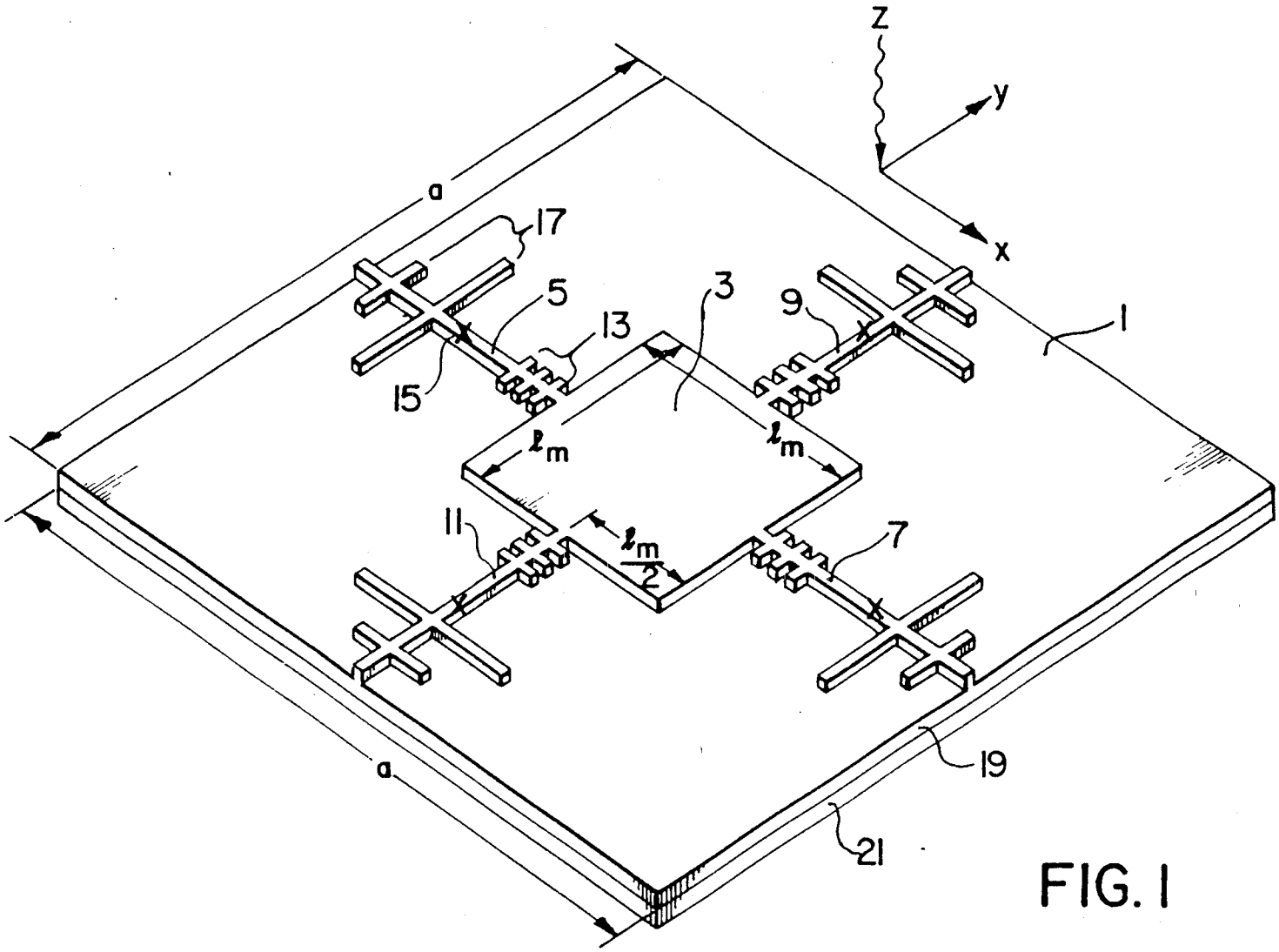
FIG. 1 is a perspective view of the present invention of an antenna unit having one of four identical feedlines connected to the middle of each side of a square patch antenna element.

FIG. 1 illustrates a single antenna unit 1 according to the present invention which is positioned to intercept a portion of an electromagnetic beam transmitted in a direction z perpendicular to the plane (x,y) of the unit as shown in the Figure. The remote transmit antenna emits dual polarized waves, that is waves of two orthogonal polarizations, which could be unequal in amplitude and phase. These two orthogonal field components of the incident beam can be resolved into components aligned into each of the two directions x and y, parallel to the side (dimension $\mathbf{1}_m$) of the square patch antenna element 3. Due to the symmetrical nature of the patch antenna element and feeding locations, the two x-directed feedlines 5 and 7 are capable of selectively receiving the transmitted wavefield component oriented in the x direction, and similarly the two y-directed feedlines 9 and 11 selectively receive the other orthogonal component of the transmitted wavefield. An antenna unit 1 consists of a square patch antenna element 3 of dimension $\mathbf{1}_m$ with four feedlines at the middle of the sides. Each of these feedlines includes filters 13, a diode rectifier terminal 15 and matching stubs 17 shorting the transmission line waves at the fundamental and second harmonic. The microstrip circuit elements such as antenna elements, filters and stubs consist of conductor patterns on a layer of dielectric material 19 typically between 0.02 $\lambda_o$ to 0.09 $\lambda_o$ thick, backed by a sheet of conductive material dimension a which serves as a ground plane 21.

Figure 2:
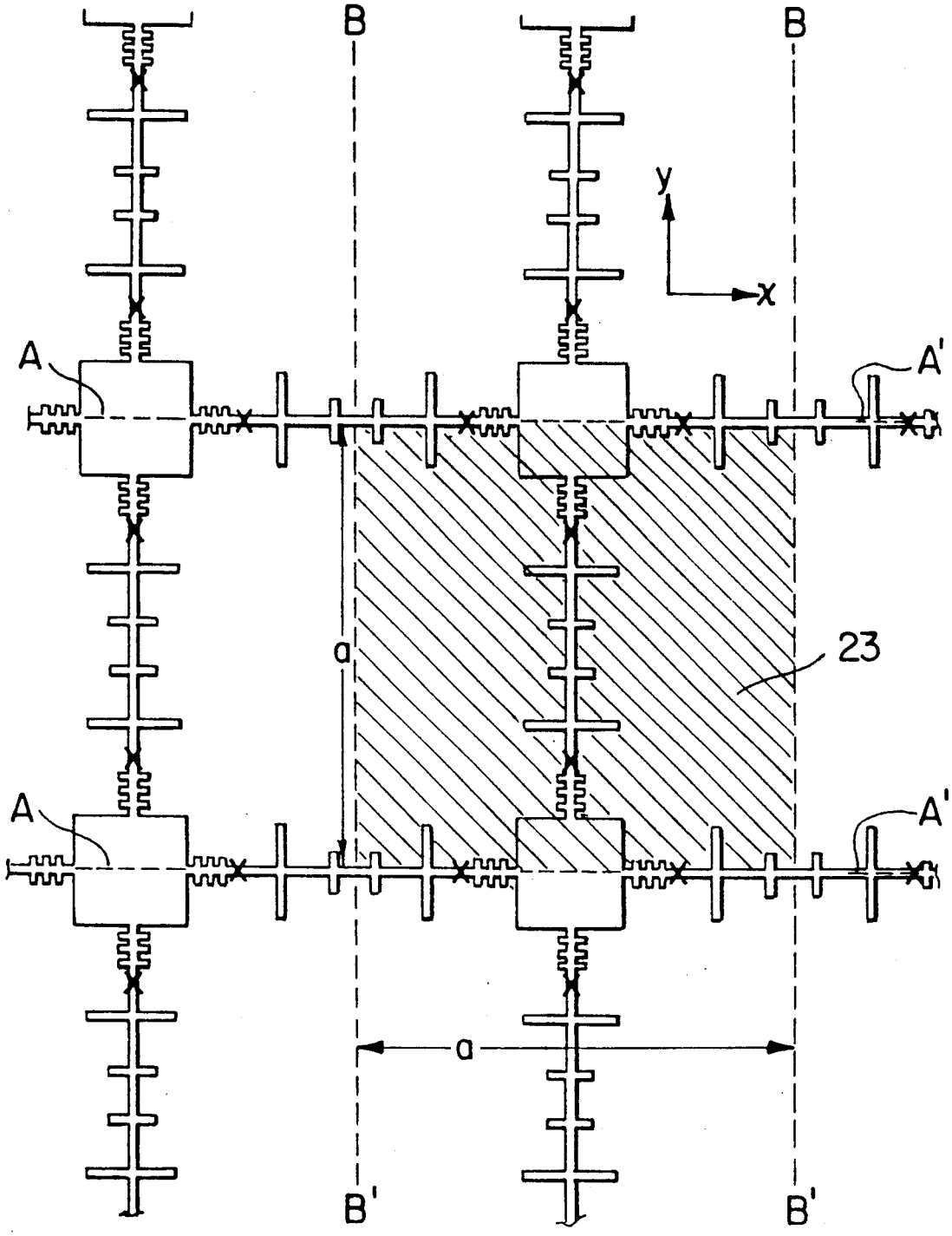
FIG. 2 is a plan view of portion of an array antenna showing symmetrically arranged antenna units according to the present invention.

FIG. 2 shows a plan view of a fragmentary section of an array of antenna units of FIG. 1, each unit being dc connected to its four adjacent units by appropriate feedlines. All antenna sources of dc power after rectification are thus connected in parallel in this embodiment. Due to the symmetry of the antenna layout, for the component of the incident electric field aligned in the y direction, ideal electric walls may be placed in the planes passing through lines AA' and ideal magnetic walls correspondingly located through lines BB' as shown in the figure. These walls, extending in front of the antenna elements, define identical square transmission line cells enclosing each element of the array (in an analogous fashion to the aforementioned U.S. Pat. No. 4,943,811. Once the walls are present, the field outside the cell may be completely ignored and the array behaviour determined from the behaviour of a single transmission line cell, such as that represented by the hatched area 23 for the y-polarized wave. All mutual coupling due to neighbouring elements is automatically taken into account by the configuration of this invention. Similar cells can be constructed when considering the x-polarized wave. Microstrip filters and matching stubs are included in the figure which also illustrates terminals designated by x for diode rectifiers.

Figure 3:
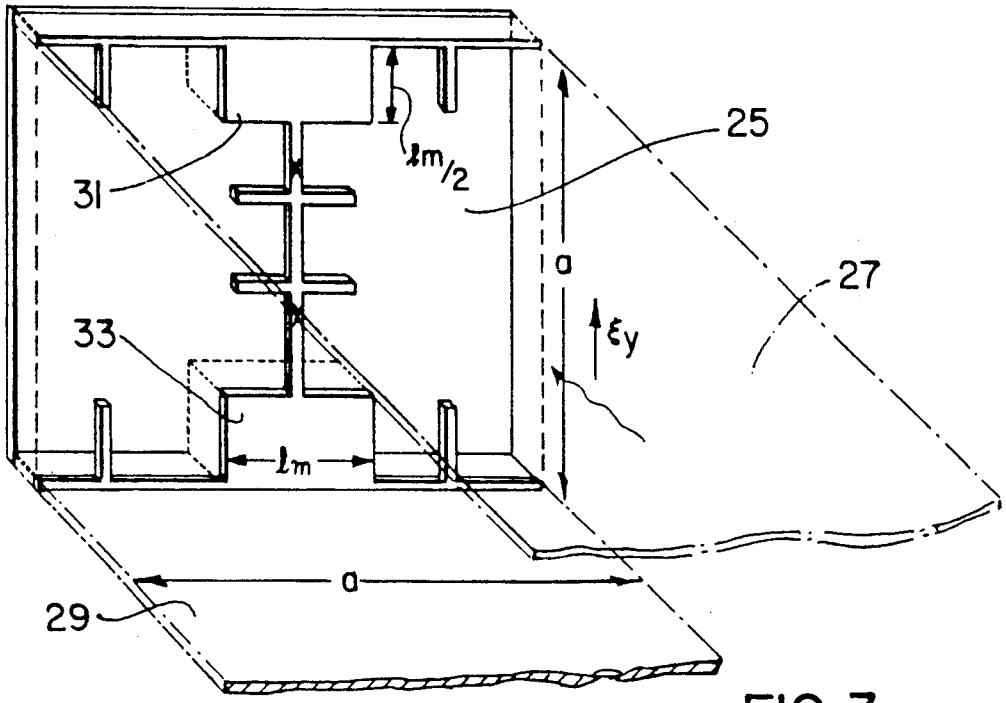
FIG. 3 is an perspective view of an independent transmission line cell, a concept by which means the behaviour of the antenna array may be visualized and analyzed.

FIG. 3 shows a perspective view of a transmission line cell 25 for the y-polarized component, where nonessential details, e.g. filters of the feedlines, are omitted for clarity. Viewed from the direction of the incident beam, the transmission line cell appears as a parallel plate line (top plate 27 and bottom plate 29) with ideal electric and magnetic walls. In accordance with standard transmission line theory, the cell dimension a must be made less than $\lambda_o$ to prevent higher order modes flowing down the parallel plate line. The parallel plate line is terminated with a capacitive diaphragm (the two antenna halves 31 and 33). This diaphragm capacitively couples the y component of electric field into equal and opposite field components between the upper conductor of the patch antennas and the ground plane, that is into the ends of the microstrip feedlines, the antenna halves and their loads. Because of the symmetrical construction of the filters and matching stubs, no incident power is coupled by these elements to the x feedline (and no power will be radiated by these elements from the x feedline for the x-directed component of the incident beam). This is equivalent to the radiation null at broadside observed for rectangular patch antennas when fed at the patch center. The matching stubs and filter elements of the x feedlines then appear as capacitive elements across the parallel plate line, while the y feedlines serve as an inductive coupling between the two elements of the diaphragm. Diode rectifiers are connected at locations marked x. In this figure only the rectifiers connected to the y feedlines produce output.

Figure 4:
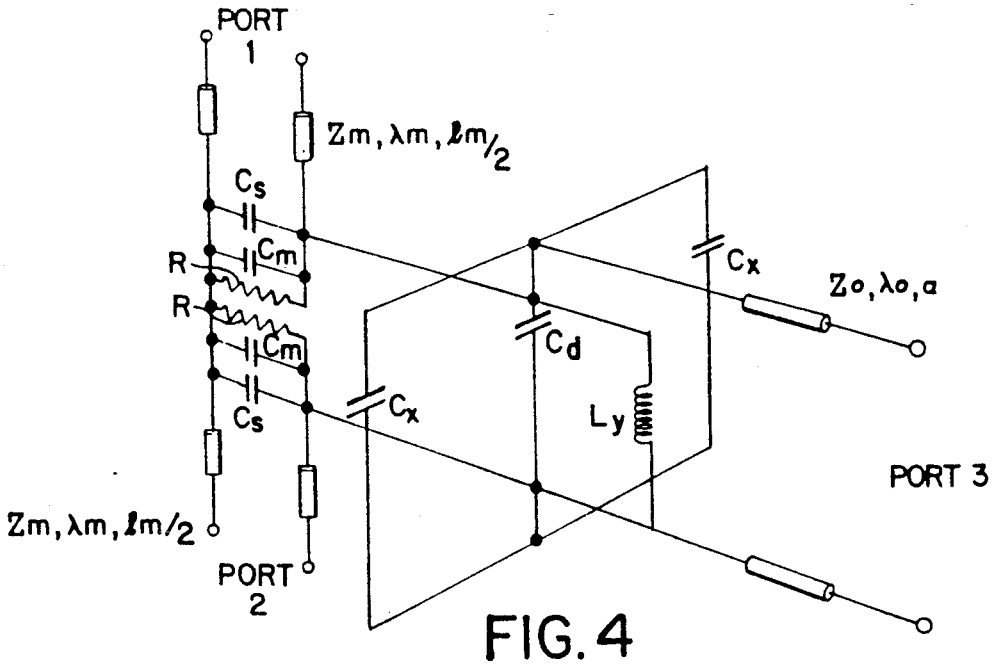
FIG. 4 shows an electrical equivalent circuit for the transmission line cell of FIG. 3 leading to a condition for maximum efficiency of power reception.

FIG. 4 shows an equivalent circuit for the transmission line cell of FIG. 3, based upon standard equivalent circuits for transmission line discontinuities. In the figure, the following designations are employed:

$C_d$—capacitive diaphragm (antenna) across parallel plate line;

$C_x$—filter and stub elements of x feedline;

$L_y$—inductive coupling of y feedline between halves of diaphragm (antenna);

$C_s$—reactances modelling the distortion of the electric field at the edges of the antennas;

$C_m$—discontinuity due to junction of y feedline and antenna;

$Z_o$, $\lambda_o$, a—characteristic impedance, wavelength, and dimension of parallel plate line (free space equivalent);

$Z_m$, $\lambda_m$, $l_m/2$—characteristic impedance, wavelength, and length of microstrip transmission line comprising each patch antenna half;

R—antenna conversion circuitry load, e.g. rectifiers etc., seen by patch antenna at each edge, made equal to $Z_o/2$.

From FIGS. 2 and 3 it is evident that the boundary conditions at the "open" terminals of the two antenna halves must match, that is ports 1 and 2 are connected.

It may then be shown by standard circuit analysis techniques that by choosing the patch antenna dimension such that:

$$l_m = \frac{\lambda_m}{\pi} \tan^{-1}\left\{ \frac{1}{2Z_m\left\{2\pi f\left(C_d + 2C_x + \frac{C_m}{2} + \frac{C_s}{2} - \frac{1}{2\pi f}\left(\frac{1}{L_y}\right)\right)\right\}} \right\}$$

the various reactances, describing the effect of the antenna and circuit elements upon the incident plane wave, may be "tuned out" and the wave matched to the antenna load 2R, e.g. rectifiers, etc. The effect of feedlines and mutual coupling between elements is compensated and high efficiency of power reception achieved. The same argument may be made for the x-polarization waveguide component. In the equation, f is the frequency of the incoming wave. In practice, the parameters on the right hand side of the equation above are functions of $l_m$ and a and these dimensions are chosen to satisfy the equation. Typical dimensions are $a=0.5\ \lambda_o$, $l_m=0.4\lambda_m=0.12\lambda_o$, for a microstrip substrate of 12.8 relative dielectric constant (representative of materials likely to be used as a substrate) and thickness $0.02\ \lambda_o$. At the ISM microwave powering frequency of 2.45 GHz $\lambda_o \simeq 12.2$ cm.

The above explanation has considered the case of a beam normally incident on an array, however this method of compensation is applicable to any specified angle of incidence, upon modification of the transmission line cell (parameters $Z_o$, $\lambda_o$) to one whose walls are no longer electric and magnetic (ideal parallel plate line) but dependent upon the angle of beam incidence. The reactances of the above equation are also a function of the type of transmission line cell. This angle is usually chosen as that most desirable for matching the antenna to its power conversion circuit over the operational range of beam incidence, and it (though not polarization orientation) can often be strictly controlled, in order to maintain the impedance stability necessary for total energy absorption. Since both $Z_o$ and the various reactances (in particular $C_d$) are functions of the angle of beam incidence, mismatch between the antenna load impedance 2R and the incoming wave,.impedance $Z_o$ may be reduced by the compensating variation of $C_d$, in cases where the range of beam incidence cannot be carefully limited.

Furthermore, once the dual polarization system is formulated in the network terms of FIG. 4, according to the configuration of the present invention, the effect of changes or modifications to the system may be quantified and compensated for according to the aforementioned network model. For example, a dielectric radome may be placed directly on top of the antenna plane for system environmental protection, resulting in changes in the wavelength and characteristic impedance in a small region of the cell above the antenna array.

With a ground plane connected directly to the source of heat dissipation (diode rectifiers) and in good thermal contact with the conversion circuitry, the possibility exists for heat dissipation from the ground plane via radiation or transfer to a convective coolant. Because a single layer of antenna elements and feedlines is required, a simple single photoetching process suffices in its manufacture. Without requirement of sensitive back-to-front registration, the present design is suitable for antennas or rectennas in the millimeter and infrared ranges as well as microwaves. It should also be noted that with a single thin conductor-clad dielectric for the microstrip elements, no reflector plane at multiples of $\frac{1}{4}$ the wavelength of the electromagnetic wave is required, allowing versatility in design by means of the isolation between the structural requirements of the platform and the electromagnetic function of the rectenna.

It should also be noted that although the above treatment has considered only planar arrays, the analysis is applicable also to non-planar arrays having rotational symmetry. Examples of these surfaces are antenna arrays on all or part of the cylindrical fuselage of an aircraft or missile, and cylindrical rectenna arrays near the focus of a microwave power concentrator.

The use of arrays of square patch antenna with feedlines in the center of adjacent edges is known to the art. These prior devices suffer, however, a severe limitation if applied to the reception of a power transmission wavefield over a wide range of angles of incidence, because the directivity of such arrays is proportional to the ratio of the wavelength to the dimensions of the array. On the other hand, with rectenna arrays and with incoherent addition of the output of each element of the array, the directivity of the array is given by the directivity of each element of the array and hence power transmission wavefields can be received over a wide range of incidence angles. In addition, it will be readily apparent to those familiar in the art that lack of consideration of antenna element spacing and transmission line configuration (e.g. as in U.S. Pat. No. 4,079,268), can lead to loss of reception efficiency due to mismatch between the incoming wave and the system of mutually interacting antennas and transmission lines. Also, unless the effect of coupling between free space and the open-circuit ends of the filters and stubs is considered, efficiencies of reception and conversion may be degraded by these unwanted interactions.

The present invention removes the above difficulties of other microstrip systems and hence increases the overall dual polarization power conversion efficiency by a specific choice of rectenna format and dimensions.

Figure 5:
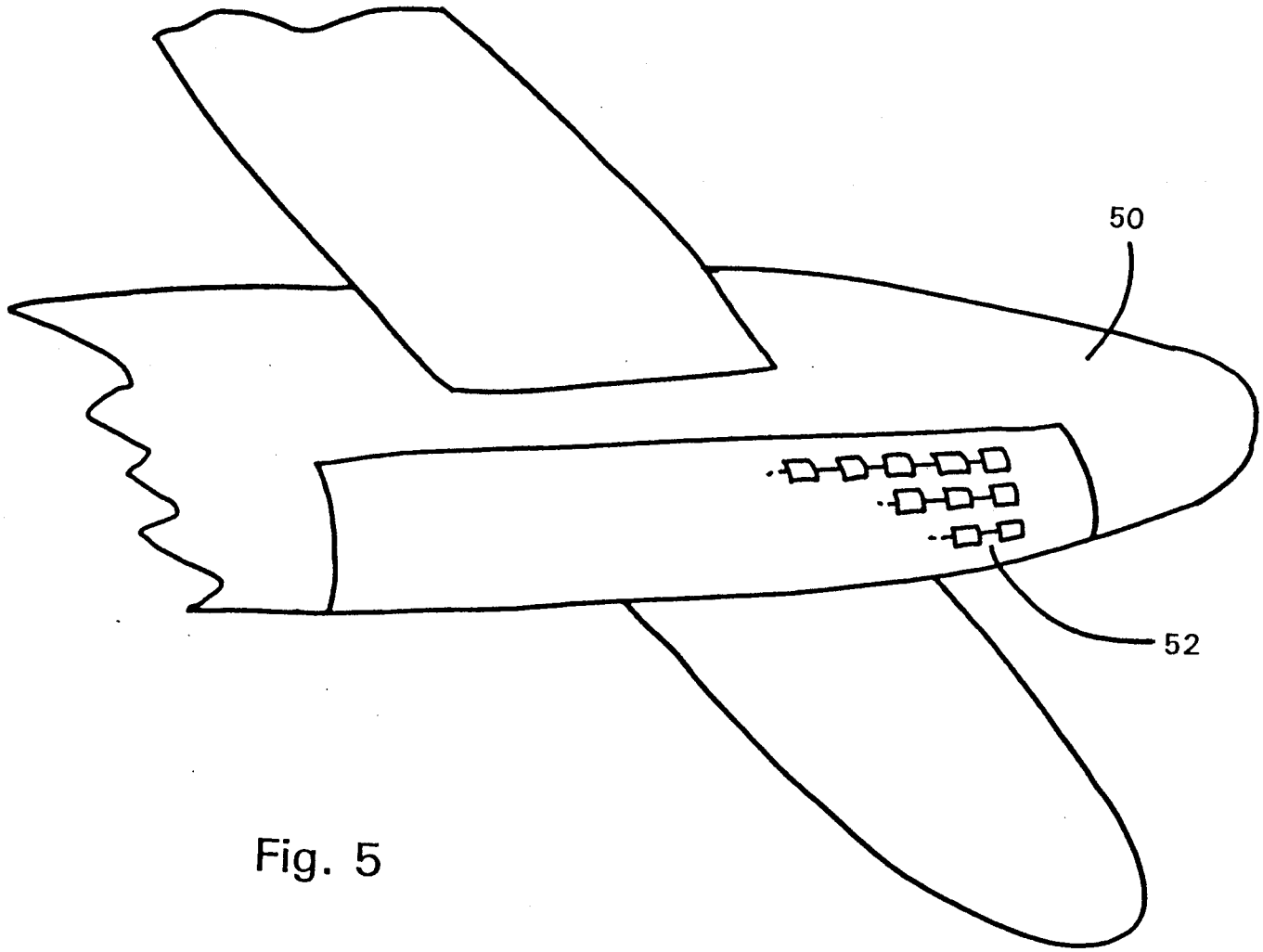
FIG. 5 shows a perspective view of the dual polarization antenna fitted on a fuselage of an airplane according to one of the embodiments of the invention.

In FIG. 5, another embodiment of the present invention is perspectively shown. An aircraft fuselage 50 is provided with a microstrip array antenna 52 on is lower cylindrical surface. The antenna is provided to receive or transmit electromagnetic wave from a ground based antenna.

We claim:

1. A dual polarization microstrip array antenna for power reception or transmission of electromagnetic waves comprising:

a plurality of identical antenna units facing the same direction, arranged symmetrically in an array in two orthogonal directions, each of the said antenna units comprising a patch antenna element and a plurality of substantially identical feedlines extending along axes, each axis being in a respective one of said two directions, said feedlines being attached symmetrically to the said patch antenna element on opposite sides thereof along respective axes microstrip filters connected to each of the said plurality of feedlines, microstrip matching stubs connected to each of the feedlines at positions remote from the patch antenna element and microstrip filters for shorting electromagnetic waves propagating along the said feedlines at fundamental and second harmonic frequencies, and a terminal for a rectifier connected to each feedline between said filters and said matching stubs, a dielectric layer of a predetermined thickness, said plurality of identical antenna units being arranged symmetrically in the said array on said dielectric layer, means for dc connecting feedlines of adjacent antenna units at positions to the side of said stubs remote from the patch elements, and a common ground plane disposed on the other side of the said dielectric layer, whereby isolated transmission lien cells and separate antenna units connected in parallel are formed.

2. The dual polarization microstrip antenna according to claim 1 wherein the said plurality of identical antenna units are arranged symmetrically in a square array in the said two directions.

3. The dual polarization microstrip array antenna according to claim 2 wherein each of the said antenna units comprises a square patch antenna element having four sides and four feedlines, each of which said feedlines is attached symmetrically to the said square patch antenna element at the middle of each of the said sides in the said two directions.

4. The dual polarization microstrip array antenna according to claim 3 wherein the said four feedlines of the said each antenna unit are arranged in two orthogonal directions.

5. The dual polarization microstrip array antenna according to claim 4 wherein in each of the said feedlines, the said microstrip filters are connected to the square patch antenna element, the said microstrip matching stubs are connected to the said microstrip filters and the said terminal is located on the feedline between the said filters and the said stubs.

6. The dual polarization microstrip array antenna according to claim 2 wherein the patch antenna elements and said feedlines are coplanar in a single conductive layer and are integral to each other.

7. The dual polarization microstrip array antenna according to claim 3 wherein the square patch antenna elements and said feedlines are coplanar in a single conductive layer and are integral to each other.

8. The dual polarization microstrip array antenna according to claim 4 wherein the square patch antenna elements and said feedlines are coplanar in a single conductive layer and are integral to each other.

9. The dual polarization microstrip array antenna according to claim 5 wherein the square patch antenna elements and said feedlines are coplanar in a single conductive layer and are integral to each other.

10. The dual polarization microstrip array antenna according to claim 6 wherein the said dielectric layer is curved.

11. The dual polarization microstrip array antenna according to claim 7 wherein the said dielectric layer is curved.

12. The dual polarization microstrip array antenna according to claim 8 wherein the said dielectric layer is curved.

13. The dual polarization microstrip array antenna according to claim 9 wherein the said dielectric layer is curved.

14. A dual polarization microstrip array antenna for power reception or transmission of electromagnetic waves comprising:

a plurality of identical antenna units facing the same direction, arranged symmetrically in an array in two orthogonal directions, each of the said antenna units comprising a patch antenna element and a plurality of substantially identical feedlines extending along axes, each axis being in a respective one of said two directions; said feedlines being attached symmetrically to the said patch antenna element on opposite sides thereof along respective axes, microstrip filters connected to each of the said plurality of feedlines, microstrip matching stubs connected to each of the feedlines at positions remote from the patch antenna element and microstrip filters for shorting electromagnetic waves propagating along the said feedlines at the fundamental and second harmonic frequencies, and a terminal for a rectifier connected to each feedline between said filters and said matching stubs, a dielectric layer of a predetermined thickness, said plurality of identical antenna units being arranged symmetrically in the said array on said dielectric layer, means for dc connecting feedlines of adjacent antenna units at positions to the side of said stubs remote from the patch elements, a common round plane disposed on the other side of the said dielectric layer, each of said antenna units comprising a square patch antenna element having four sides and four feedlines, sad feedlines being attached symmetrically to said square patch antenna element at the middle of each of said sides in said two directions, each of said feedlines of each antenna unit being arranged in two orthogonal directions, in each of said feedlines, each microstrip filters being connected to the square patch antenna element, said microstrip matching stubs being connected to said microstrip filters, said terminal being located on the feedline between said filters and said stubs, wherein the dimension $1_m$ of the side of the said square patch antenna element is determined by the following equation:

$$l_m = \frac{\lambda_m}{\pi} \tan^{-1}\left\{ \frac{1}{2Z_m\left\{ 2\pi f\left( C_d + 2C_x + \frac{C_m}{2} + \frac{C_s}{2} \right) - \frac{1}{2\pi f}\left( \frac{1}{L_y} \right) \right\}} \right\}$$

where:

f—frequency of the waves, $C_d$—capacitive diaphragm (antenna) across parallel plate line $C_x$—filter and stub elements of x feedline $L_y$—inductive coupling of y feedline between halves of diaphragm (antenna)

$C_s$—reactances modelling the distortion of the electric field at the edges of the antennas $C_m$—discontinuity due to junction of y feedline and antenna, and $Z_m$, $\lambda_m$, $l_m/2$—characteristic impedance, wavelength, and length of microstrip transmission line comprising each patch antenna half.

15. The dual polarization microstrip array antenna according to claim 14 wherein the square patch antenna elements and said feedlines are coplanar in a single conductive layer and are integral to each other.

16. The dual polarization microstrip array antenna according to claim 15 wherein the said dielectric layer is curved.

* * * * *